United States Patent [19]

Tanuma et al.

[11] Patent Number: 5,039,237

[45] Date of Patent: Aug. 13, 1991

[54] DOT MATRIX PRINT HEAD DRIVE METHOD

[75] Inventors: Jiro Tanuma; Hideaki Ishimizu; Tadashi Kasai; Hiroshi Sakaino, all of Tokyo, Japan

[73] Assignee: Oki Electric Industry Co., Ltd., Tokyo, Japan

[21] Appl. No.: 452,381

[22] Filed: Dec. 19, 1989

Related U.S. Application Data

[63] Continuation-in-part of Ser. No. 201,404, Jun. 2, 1988, abandoned, Continuation-in-part of Ser. No. 245,291, Sep. 16, 1988, abandoned.

[30] Foreign Application Priority Data

Jun. 2, 1987 [JP] Japan ..... 62-137733
Sep. 17, 1987 [JP] Japan ..... 62-231189

[51] Int. Cl.[5] ..... B41J 2/30

[52] U.S. Cl. ..... 400/124; 400/157.3; 400/175

[58] Field of Search ..... 400/121, 124, 157.2, 400/157.3, 175, 692, 703, 704

[56] References Cited

U.S. PATENT DOCUMENTS

| | | | |
|---|---|---|---|
| 4,162,131 | 7/1979 | Carson, Jr. et al. | 400/124 |
| 4,189,246 | 2/1980 | Kane | 400/157.3 |
| 4,281,938 | 8/1981 | Phillips | 400/144.2 |
| 4,597,328 | 7/1986 | Carrington et al. | 400/166 |
| 4,741,634 | 5/1988 | Nozaki et al. | 400/175 |
| 4,741,636 | 5/1988 | Tokahashi et al. | 400/175 |
| 4,764,039 | 8/1988 | Bublitz | 101/93.14 |
| 4,778,291 | 10/1988 | Mitsuhashi | 400/692 |

FOREIGN PATENT DOCUMENTS

| | | | |
|---|---|---|---|
| 3233425 | 4/1984 | Fed. Rep. of Germany | 400/175 |
| 3445908 | 6/1986 | Fed. Rep. of Germany | 400/692 |
| 21124 | 2/1979 | Japan | 400/157.3 |
| 38277 | 4/1981 | Japan | 400/157.3 |
| 120374 | 9/1981 | Japan | 400/124 |
| 156271 | 9/1982 | Japan | 400/124 |
| 53452 | 3/1983 | Japan | 400/124 |
| 190873 | 10/1984 | Japan | 400/175 |
| 54975 | 3/1986 | Japan | 400/157.3 |
| 28256 | 2/1987 | Japan | 400/124 |

OTHER PUBLICATIONS

*Research Disclosure,* "Printhead Test Fixture", Anonymous, Jun. 1987, No. 278, 400/704.

*IBM Technical Disclosure Bulletin,* "Acoustical Diagnostic Analysis of Individual Print Wire Actuator", Anon., vol. 30, No. 5, Oct. 1987, pp. 342; 400/704.

*Primary Examiner*—David A. Wiecking

*Attorney, Agent, or Firm*—Wenderoth, Lind & Ponack

[57] ABSTRACT

In a dot matrix print head drive method for controlling head drive signals for driving dot pins in accordance with print pattern signals, a correction factor is set specifically to each dot pin; and the length of time for which the print pattern signals are to remain in effects is varied according to the correction factor, to correct the drive time for each dot pin.

10 Claims, 14 Drawing Sheets

FIG. 11

| ADDRESS | DATA |
|---|---|
| $A_1$ | $Y(1)$ |
| $A_2$ | $Y(2)$ |
| ⋮ | ⋮ |
| $A_n$ | $Y(n)$ |

| | | | |
|---|---|---|---|
| Y(1) | Y(2) | ----- | Y(n) |

DOT MATRIX PRINT HEAD DRIVE METHOD

CROSS-REFERENCE TO RELATED APPLICATIONS

This application is a continuation-in-part of now abandoned application Ser. No. 07/201,404, filed Jun. 2, 1988 and now abandoned application Ser. No. 07/245,291, filed Sept. 16, 1988.

BACKGROUND OF THE INVENTION

This invention concerns a method for driving dot matrix print heads in serial dot matrix printers for printing characters and graphics responsive to data transmitted from data processing equipment.

In a serial dot matrix printer, dot printing is made while the dot matrix print head is moved by a space motor, and linefeed is made by a linefeed motor. Characters and graphics are printed by repeating these operations. Of these operations, the drive of the dot print head affects the resulting print quality and print speed.

FIG. 1 is a block diagram of a dot print head control circuit in which the conventional dot print head drive method is applied. FIG. 2 is a timing chart illustrating the operation of the components in FIG. 1. In these figures, 1 denotes an instruction circuit, 2 denotes a drive time signal generation circuit, 3 a drive circuit, and 4 a dot print head.

Instruction circuit 1 is comprised of a microcomputer. For each timing signal a, instruction circuit 1 sets print pattern signal b (#b1, #b2, . . . , #bn, where n is a dot pin number) to high level "1", corresponding to the dot pins in dot print head 4 to be actuated for printing, and transmits the signals to drive circuit 3; at the same time, instruction circuit 1 transmits drive signals c, which have different effective time values depending on the number of dot pins energized, to drive time signal generator circuit 2.

Upon input of drive signal c from instruction circuit 1, drive time signal generator circuit 2 generates drive time signal T1 for releasing the dot pins P1 to Pn, which are pulled in when not in use for printing, and drive time signal T2 for maintaining the self-holding current and preventing the dot pins from being pulled in during printing, and sends these drive time signals T1 and T2 to drive circuit 3.

FIG. 3 is a circuit diagram of drive time signal generator circuit 2. Its operation will now be described. When drive signal c is input to inverter 2*a* capacitor C1 which has been charged is discharged at a rising edge of the drive signal c. Then capacitor C1 is charged by current from drive voltage $V_{cc}$ via resistor R1 at a falling edge of the drive signal c. The output d of the inverter 2*a*, which is called a charge/discharge signal, is input into one input terminal (+) of the comparator 2*b* and one input terminal (+) of another comparator 2*c*. The +5 V voltage is divided by resistors R2 and R3, and resistors R4 and R5. The voltage across resistor R5 is input as slice level SL1 to the other input terminal (−) of comparator 2*b*. Likewise, the voltage across resistor R3 is input as slice level SL2 to the other input (−) of comparator 2*c*. Slice level SL2 is set higher than slice level SL1. Thus, as illustrated in FIG. 2, as long as the level of charge/discharge signal d is less than slice level SL1, the output of comparator 2*b*, i.e., drive time signal T1 is kept at high level "1", and as long as the level of charge/discharge signal d is less than slice level SL2, the output of comparator 2*c*, i.e., drive time signal T2 is kept at high level "1".

Upon receipt of the input of print pattern signal b (#b1, #b2, . . . , #bn), and the input of drive time signals T1 and T2 at high level "1", drive circuit 3 (FIG. 1) generates head drive signal e (#e1, #e2, . . . , #en) corresponding to the dot pins, to drive dot print head 4.

FIG. 4 is a circuit diagram of drive circuit 3. As illustrated in FIG. 4, inverter 3*a* receives drive time signal T1, which is transmitted from drive time signal generator circuit 2. The output of inverter 3*a* is applied to the base of transistor TRn+1. AND circuits 3*b*-1, 3*b*-2, . . . , 3*b*-n are provided for respective dot pins. Each of the AND circuits 3*b*-1 to 3*b*-n receives drive time signal T2 from drive time signal generator circuit 2. AND circuits 3*b*-1 to 3*b*-n also reseive print pattern signals #b1 to #bn respectively of the print pattern signal b from instruction circuit 1. AND circuits 3*b*-1 to 3*b*-n perform logical product operation, and the outputs from these AND circuits are input, respectively, to the bases of transistors TR1 to TRn, provided for respective dot pins. The emitter of transistor TRn+1 is connected to power supply VMM, and its collector is connected to one end of each of head coils L1 to Ln. The other ends of head coils L1 to Ln are connected, respectively, to the collectors of transistors Tr1 to TRn. Emitters of transistors TR1 to TRn are connected to ground G. Diode Dn+1 is connected across head coils L1 to Ln and transistors TR1 to TRn with its anode grounded. Diodes D1 to Dn are connected between respective collectors of transistors TR1 to TRn and the emitter of transistor TRn+1 with their anodes connected to the collectors of transistors TR1 to TRn.

The following explains the operation of the system as configured above, and in particular the operation of dot pin No. 1 in dot print head 4.

In response to timing signal a, instruction circuit 1 raises print pattern signal #b1 to high level "1" and sends it to drive circuit 3, simultaneously sending drive signal c to drive time signal generator circuit 2 via inverter 2*a*. When drive signal c rises, capacitor C1 that has been charged is discharged. The level of charge/discharge signal d gradually decreases and when it becomes equal to slice level SL2, comparator 2*c* sets drive time signal T2 to high level "1", and sends it to drive circuit 3; likewise, when the level of charge/discharge signal d becomes equal to slice level SL1, comparator 2*b* sets drive time signal T1 to high level "1", and sends it to drive circuit 3. When drive time signal T1 is high transistor TRn+1 of drive circuit 3 is turned on. Further, AND circuit 3*b*-1 performs logical product operation of drive time signal T2 at high level "1" and character pattern signal #b1 at high level "1". As a result, transistor TR1 is turned on. As a result, head drive signal #e1, or head drive current flows as shown by X1 in FIG. 2 from power supply VMM, through transistor TRn+1, head coil L1, transistor TR1, and to ground G, in that order, This, in turn, generates from coil L1 a magnetic field cancelling the magnetic field, form a permanent magnet not shown, for pulling dot pins. Because of the cancellation of the magnetic field, dot pin No. 1 (P1), being biased by a leaf spring, not shown, is moved forward (toward printing paper 7 on the platen 6) to perform one dot of printing. When drive signal c sent from instruction circuit 1 falls, capacitor C1 in drive time signal generator circuit 2 is charged up. As the level of charge/discharge signal d gradually rises and when it exceeds slice level SL1, drive time signal T1 becomes low level "0". Transistor TRn+1 in drive circuit 3 is thereby turned off. As a result, head drive signal #e1 flows through head coil L1, transistor TR1, diode Dn+1, and head coil L1, in that order. Head drive signal #e1 therefore gradually falls, as shown by X2 in FIG. 2. Further, when the level of charge/discharge signal d in drive time signal generator circuit 2 rises higher than slice level SL2, drive time signal T2 becomes low level "0". As a result, drive signal #e1 flows from ground G, through diode Dn+1, head coil L1, diode D1, and power supply VMM, in that order. Head drive signal #e1 therefore falls quickly as shown by X3 in FIG. 2.

The same operation is performed concurrently and in a similar manner on multiple dot pins that are used for printing.

According to the above scheme, however, the dot pins P1 to Pn that are driven for printing are driven for the same length of time, since print pattern signals b have the same effective period. The drive time is set to the maximum value in order to accommodate the dot pin requiring the greatest length of print time and stroke. Consequently, dot pins that print quickly or those requiring smaller strokes remain in operation by the drive current even after expiration of time required for printing. This results in delayed return. Also, since the drive time is set to the maximum drive time of the dot pins, the power consumption tends to be higher. If the drive period is shortened the problem of missing dots occurs or ribbon 5 can be caught by the pin return of which is delayed.

SUMMARY OF THE INVENTION

An object of this invention is to provide a drive time correction for individual dot pins.

Another object of this invention is to provide a dot print head drive method which would allow increase in speed and efficiency.

To accomplish the above object, this invention is characterized by varying the period for each print pattern signal according to a correction factor specific to each dot pin, thereby correcting drive time for each dot pin.

According to this invention, since the duration of time over which print pattern signals can be in effect is varied according to the correction factor specific to each dot pin, and since the head drive signals for driving dot pins can be controlled for individual dot pins, an optimum time can be set for each dot pin.

BRIEF DESCRIPTION OF THE DRAWINGS

FIG. 11 is a diagram showing an example of the characteristic values stored in the characteristics storage unit 13.

DETAILED DESCRIPTION OF THE EMBODIMENTS

Figure 5:
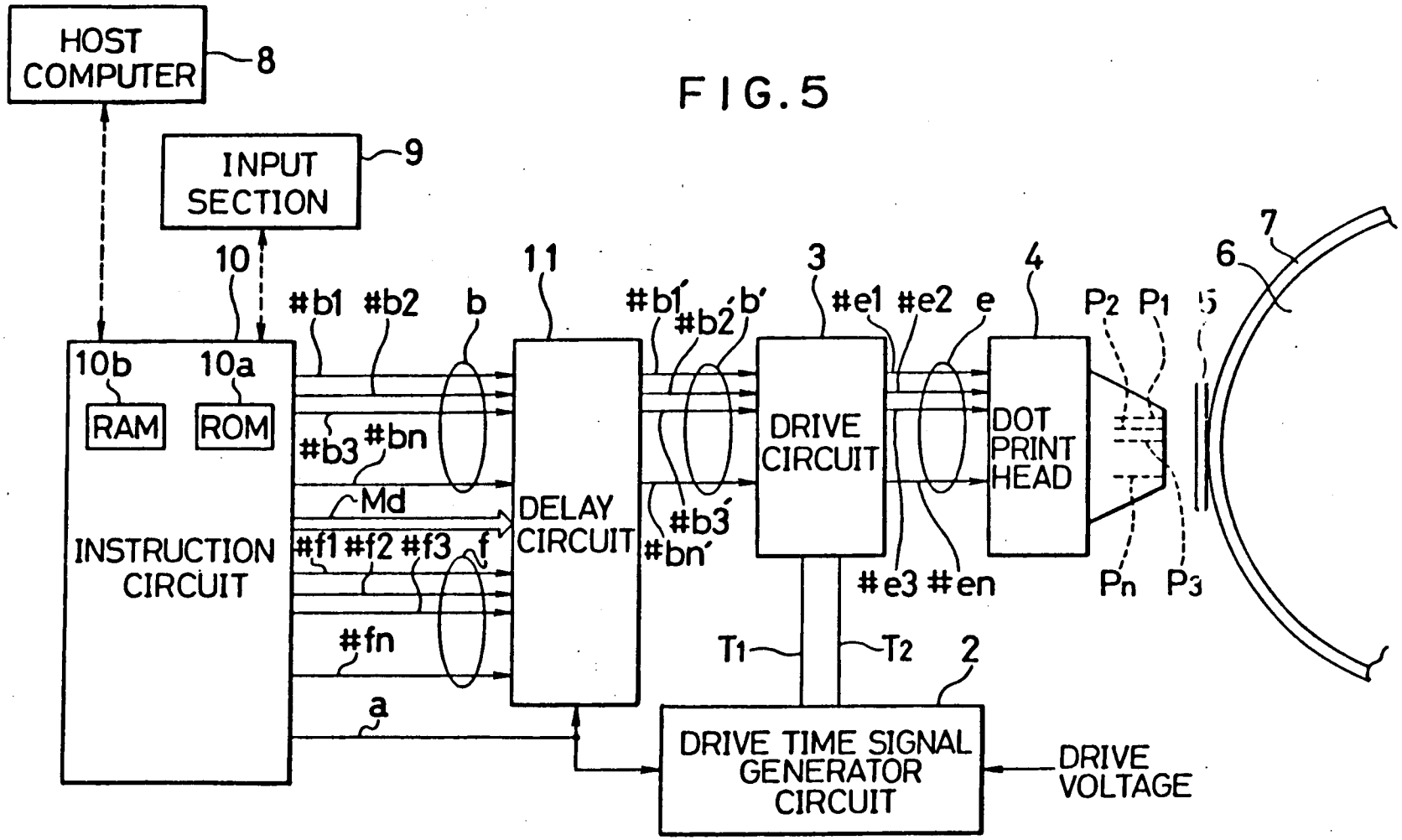
FIG. 5 is a block diagram showing the dot print head control circuit to which the dot print head drive method according to this invention is applied.
Figure 6:
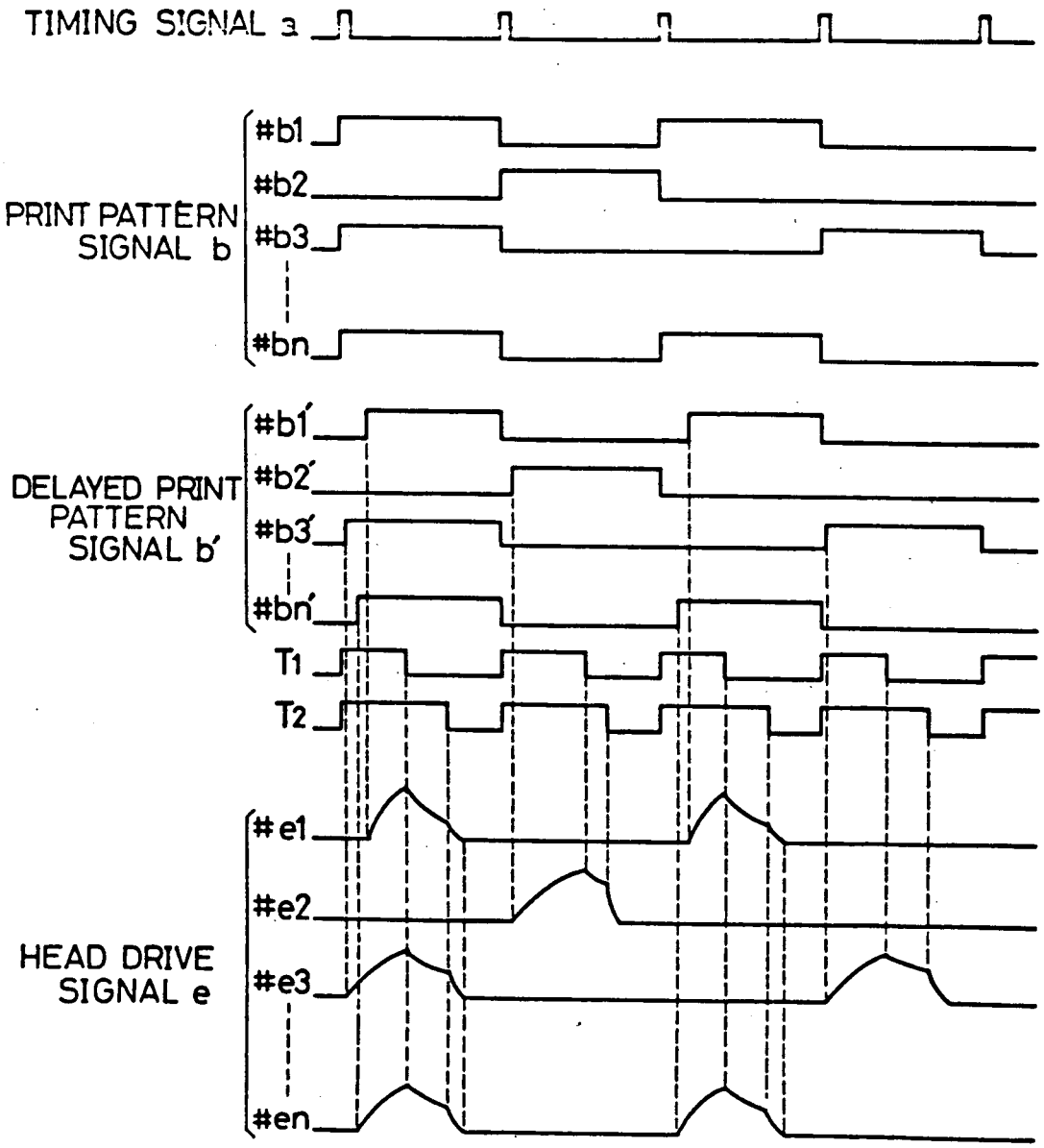
FIG. 6 is a timing chart illustrating the operation of components in the dot print head control circuit according to the present invention.

FIG. 5 is a block diagram of the dot print head control circuit to which the dot print head drive method according to this invention is applied. FIG. 6 is a timing chart illustrating the operation of the components in FIG. 5. The components that are identical to conventional configuration are indicated by identical reference marks. In the figures, 2 indicates the drive time signal generator circuit, 3 the drive circuit, 4 the dot print head, a the timing signal, b (#b1, #b2, . . . , #bn) the print pattern signals, and T1 and T2 drive time signals, and e (#e1, #e2, . . . , #en) the head drive signals.

Figure 9:
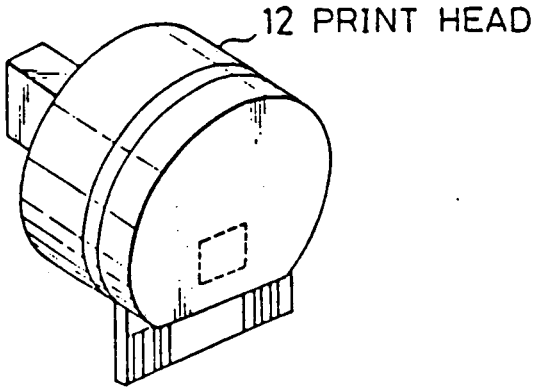
FIG. 9 is a prespective view showing an example of a print head unit 8 incorporated in the system of the invention.
Figure 10:
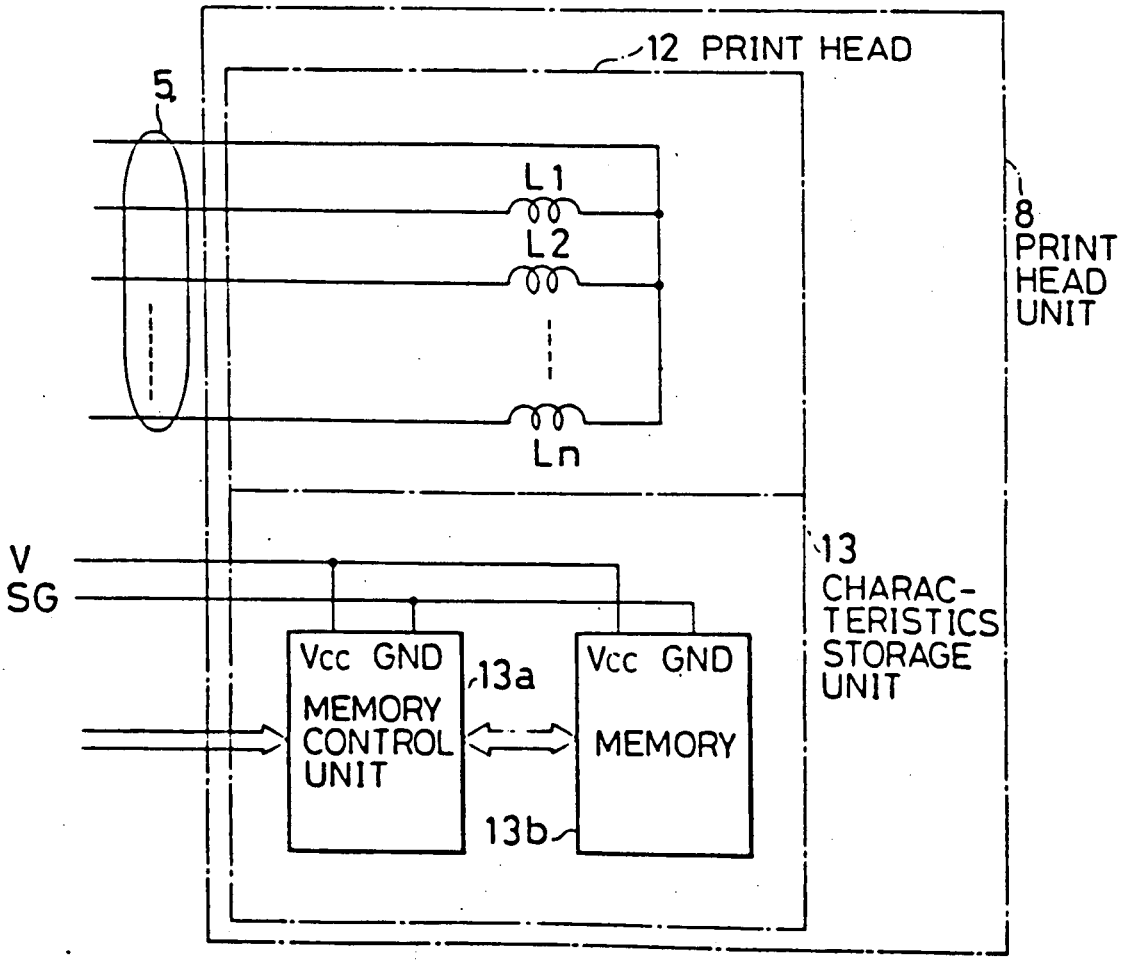
FIG. 10 is a block diagram showing an example of a print head unit 8 with a characteristics storage unit 13.

The print head unit 8 is constructed as shown in FIG. 9 and FIG. 10. The print head is generally identical to those known in the art, but it has a built-in printed circuit board, on which a characteristics storage unit 13 is mounted. The characteristic storage unit 13 is used for storing the characteristic values of dot pins obtained at the time of characteristics inspection after assembly of the print head unit 8. FIG. 10 schematically shows an example of print head main part 12 and characteristics storage unit 13. In the figure, L1 to Ln are dot pin drive coils, which are identical to those of the conventional print head. The drive coils L1 to Ln are connected through a cable 5 to the control and drive unit 9 to receive drive currents e. The characteristics storage unit 13 comprises a memory control unit 13*a* and a memory 13*b*.

The memory control unit 13*a* is comprised of a microprocessor, and performs control over reading and writing of characteristic values for the respective dot pins. The memory 13*b* is comprised of an EEPROM (electrically erasable and programmable read only memory), an EPROM (electrically programmable read only memory) or the like which is nonvolatile and permits writing from outside. As shown in FIG. 11, the memory 13*b* stores the characteristic values Y(1) to Y(n) for the respective dot pins in the respective memory addresses A1 to An. The interface for the memory control unit 13*a* is formed of a serial interface so as to reduce the number of wiring conductors. The characteristic values Y(1) to Y(n) stored in the memory 13*b* are read by the control and drive unit 9 through a cable 14 at the time of power-on reset or system reset.

The characteristic values Y(1) stored in the storage unit 13 may be values inherent to the particular dot pins of the particular print head, and are representative of characteristics, e.g., the strength of magnetization of the permanent magnets pulling the armatures to which the dot pins are attached to hold the dot pins at the retracted position, the strength of the leaf springs for driving the dot pins upon release of the dot pins from the permanent magnets. The characteristic values Y(i) can be determined through experiments, or measurement after the assembly of the print head.

Figure 12:
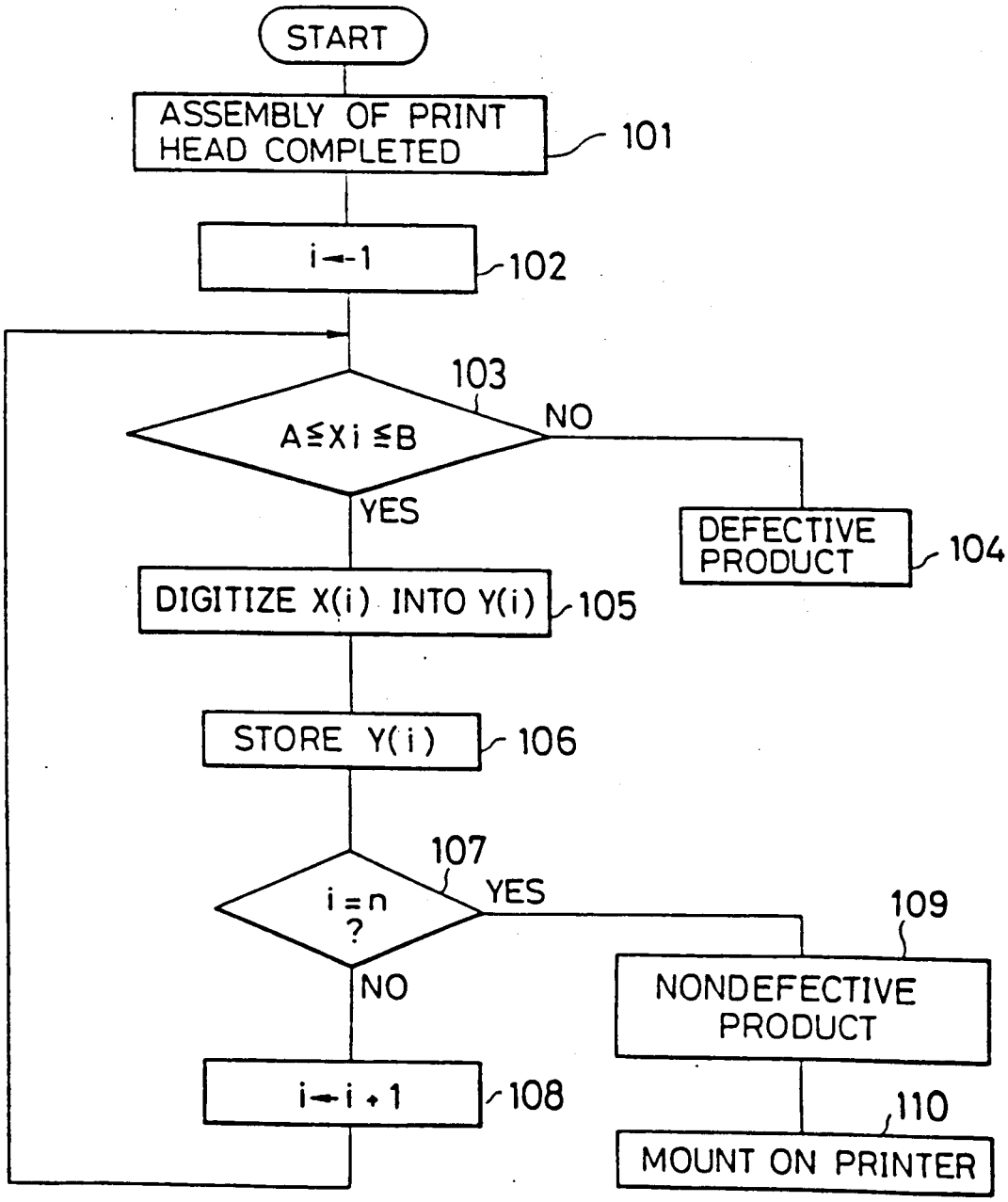
FIG. 12 is a flowchart showing how the characteristic values are stored in the characteristics storage unit 13 during inspection of the print head.

An example of the manner in which the characteristic values are determined and stored in the memory 13b will now be explained with reference to FIG. 12. After the print head unit 8 is assembled (step 101), the characteristics are inspected in turn, e.g., starting with the dot pin No. 1 (step 102). Judgement is made as to whether or not the characteristic value X(1) of the pin No. 1 is within the range between predefined lower and upper limits A and B (step 103). If it is outside the range, the print head unit 8 is rejected as a defective product (step 104). If it is within the range, the characteristic value X(1) in the form of an analog value is digitized and coded into a digital value Y(1) suitable for storage in the memory 13b (step 105). The digital characteristic value Y(1) is stored in the memory area of the address A1 (step 106). The steps 103 to 104 are repeated for all the pins (No. i=1 to n) by incrementing i (step 106) and checking whether i has reached n (step 107). If the characteristic values for all the dot pins are found to be within the above range, the print head is considered to be not defective (109) and later mounted in a printer (step 110).

10 represents the instruction circuit which, responsive to timing signal a, sets to high level "1" print pattern signals b (#b1, #b2, . . . , #bn), corresponding to the dot pins P1 to Pn in print head 4 to be driven for printing. Instruction circuit 10 sends the print pattern signals b to delay circuit 11.

Further, platen correction data PL for compensating for differences in the distances between dot pins P1 to Pn and the surface of platen 6 due to the curvature of platen 6, or strokes, and print time correcton data HD to compensate for the differences in print time between dots due to characteristics of individual dot pins and drive mechanisms therefore are stored in a ROM 10a.

More specifically, platen correction data PL(i) is a factor for compensating for the difference in the distance between the dot pin and the round surface of the platen 6, the distance varying from one dot pin to another due to the curvature of the platen. PL(i) can be theoretically determined when the radius of the platen roll and the distance between the center dot pin (dot pin in the center of the array of dot pin and hence situated nearest to the platen) and the platen are given.

Print time correction data HD(i) is a factor for compensating for the difference in characteristics of the dot pins and their drive mechanisms, e.g., the strength of magnetization of the permanent magnets pulling the armatures to which the dot pins are attached to hold the dot pins at the retracted position, or the characteristics of the leaf springs for driving the dot pins upon release from the magnets. HD(i) can be determined through experiments, or measurement of the characteristics of the individual dot pins.

Moreover, drive data DR common to all dot pins are stored in a RAM 10b and can be set and varied by operation of an input section 9 such as an operational panel or dip-switch switch.

More specifically, drive data DR is a factor common to all the dot pins. It is varied to add the same amount of correction for all the dot pins. For instance it is varied to correct for deviation in characteristics of the particular print head. It can also be varied to change the density of printing. DR can be stored in a RAM 10b and can be varied or adjusted during use of the printer by manipulation of the input section 9.

When the power is turned on or when a correction data rewriting request is made and new data DR is set, the system, using this predefined information, calculates correction factor Md according to formula (1) below for each dot pin, and transmits correction factor Md, timing signal a, and load signal f (f1 to fn) to delay circuit 11.

$$Md(i)=\alpha PL(i)+\beta HD(i)+\gamma DR \quad (1)$$

(where $1 \leqq i \leqq n$, and $\alpha$, $\beta$, and $\gamma$ are parameters for determining the correction factor Md(i)).

The coefficient $\alpha$, $\beta$ and $\gamma$ determine relative weights of the respective factors PL(i), HD(i) and DR, and can be predetermined on the basis of experiments and experiences.

Delay circuit 11 receives input of print pattern signal b transmitted from instruction circuit 10, and stores correction factor data Md sent from instruction circuit 10. It transmits to drive circuit 3 delayed print pattern signals b' (#b1', #b2', . . . , #bn') for delaying the commencement of the time period when print pattern signal b is to be sent to drive circuit 3, according to correction factor Md.

Figure 7:
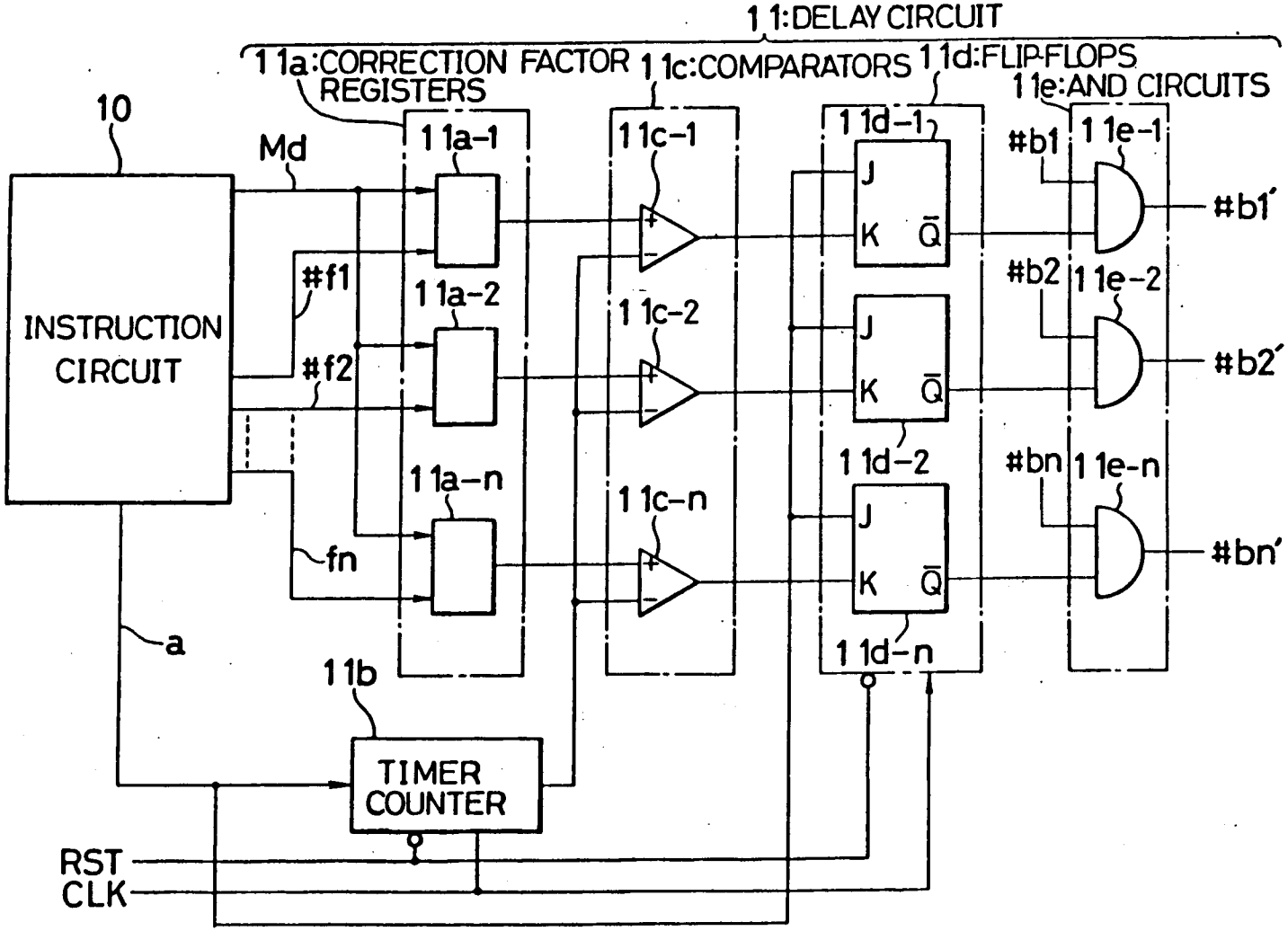
FIG. 7 is a circuit diagram of the delay circuit according to this invention.

FIG. 7 shows the circuit configuration of delay circuit 11. In this figure, 11a denotes a correction factor register, 11b a timer counter, 11c a comparator, 11d a JK flip-flop (FF), and 11e an AND circuit.

Correction factor registers 11a (11a-1, 11a-2, . . . , 11a-n) are provided for respective dot pins. Each of correction factor registers 11a stores correction factor Md(i) upon receit of the corresponding one of the load signals f (#f1 to #fn). The correction factors Md(i) and the load signals f are sent from instruction circuit 10. The output from the register 11a is input to input terminal (+) of comparator 11c.

When the power is turned on, timer counter 11b is reset by reset signal RST. When timing signal a, sent from instruction circuit 10 and synchronized to clock signal CLK, is input, the timer counter starts counting, and inputs the current count to the other input terminal (−) of comparator 11c. When another timing signal a is input, the counter resets the count, and re-starts counting from "0".

Comparators 11c (11c-1, 11c-2, . . . , 11c-n) are provided for respective dot pins. Each of the comparators compares correction factor Md(i), from the corresponding correction factor register 11a, with the count from timer counter 11b. When the count becomes equal to the correction factor, the comparator sends high level "1" to FF 11d.

FFs 11d (11d-1, 11d-2, . . . , 11d-n) are provided for respective dot pins. Timing signal a is input on one input terminal (J) of each FF 11d. On the other input terminal (K), output from comparator 11c is input. After the power is turned on, and when reset signal RST is input output Q is set to high level "1". When timing signal a, synchronized with clock signal CLK at high level "1" is input to input terminal (J), output Q falls to low level "0". When the output at high level "1" from comparator 11c is input to input terminal (K) high level "1" from output Q is sent to AND circuit 11e.

For respective dot pins, AND circuits 11e (11e-1, 11e-2, . . . , 11e-n) are provided. AND circuits perform logical product operation of the output from FFs 11d (11d-1 to 11d-n) and print pattern signals b (#b1, #b2, . . . , #bn) transmitted from instruction circuit 10, and transmit the results (logical products) to drive circuit 3 as delayed signal patterns b' (#b1', #b2', . . . , #bn').

Figure 4:
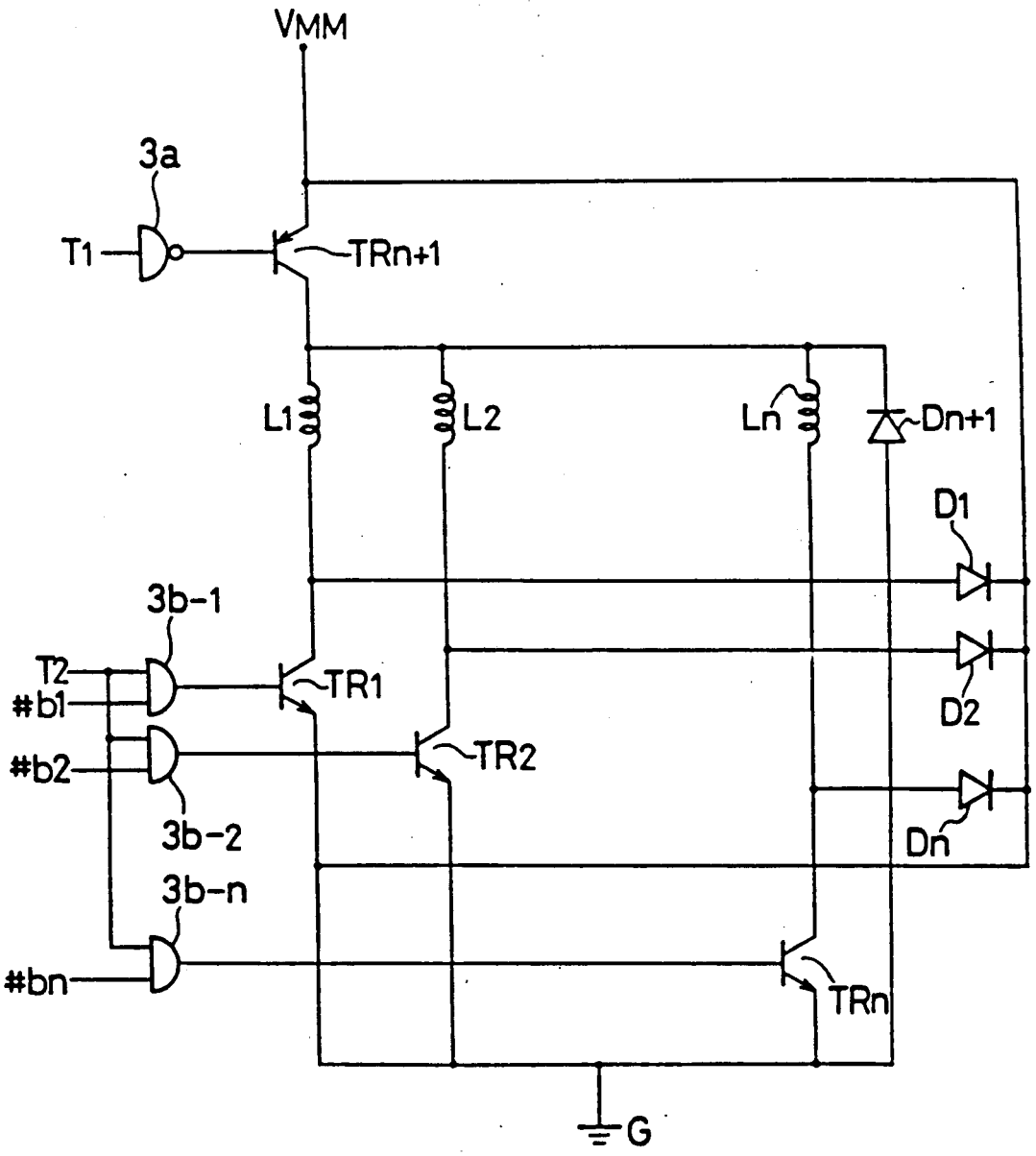
FIG.4 PRIOR ART
FIG. 4 is a circuit diagram of a drive circuit.

Drive circuit 3 has the same configuration and operates in the same way as drive circuit 3 shown in FIG. 4. But delayed print pattern signals b', instead of print pattern signals b, are supplied to AND circuits 3b-1 to 3b-n. As a result, head drive signals e (#e1 to #en) begin to rise at different times after drive time signals T1 and T2 rise to high level "1". In FIG. 6, print pattern signals #b1, #b3 and #bn associated with dot pins Nos. 1, 3 and n (P1, P3 and Pn) respectively are shown to be high during the first dot printing cycle, and accordingly corresponding delayed print pattern signals #b1', #b3' and #bn' are shown to be high. However, the times at which the signals #b1', #b3' and #bn' rise are different from each other, and accordingly the times at which head drive signals #e1, #e3 and #en begin to rise differ from each other.

On the other hand, all the head drive signals begin to fall gradually (at end of T1) and begin to fall rapidly (at end of T2) at simultaneously with each other.

Figure 8:
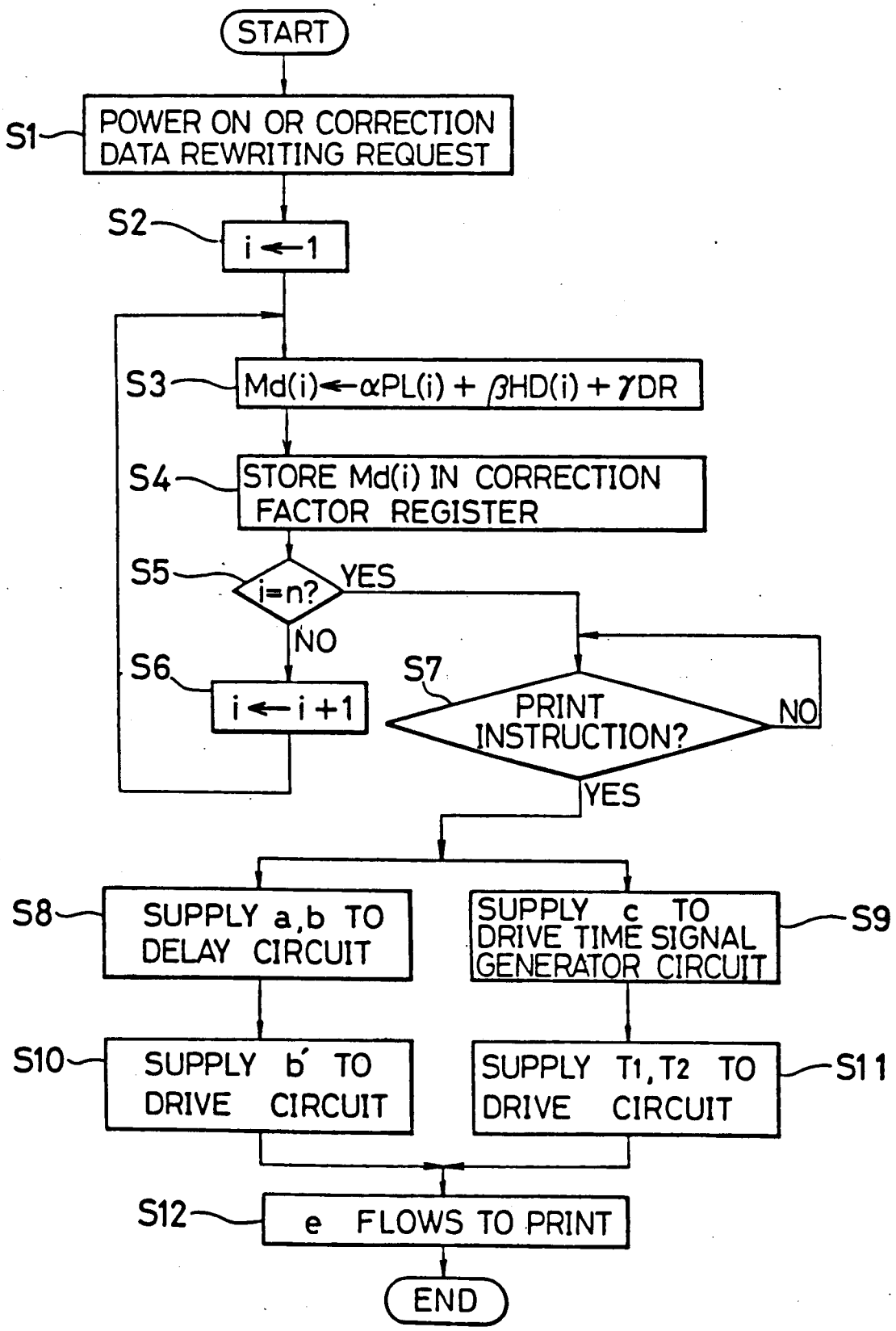
FIG. 8 is a flowchart illustrating the operation of a system according to the present invention.

The flowchart in FIG. 8 illustrates the operation of the system as configured above. First, when the power is turned on or when there is a request for rewriting correction data (S1) and the new data for DR is set, 1 is substituted for variable i (S2). Then, correction factor Md(1) is calculated for the first dot pin according to Formula (1) above (S3); and correction factor Md(1) is stored in correction factor register 11a-1 of delay circuit 11 by means of load signal f1 (S4). Then, a comparison is made to see whether or not variable i is equal to the number of dot pins, n, (S5); if they are not equal, 1 is added to variable i (S6). By repeating steps S3-S6, the system stores correction factors Md(i) for dot pins Nos. 1 through n (P1 through Pn) in correction factor registers 11a-1 through 11a-n of delay circuit 11. This completes the storage of correction factors Md(n).

When a print instruction is received from the host computer 8 (S7), instruction circuit 10 produces timing signal a, and sets print pattern signals b (#b1, #b2. . . , #bn), corresponding to the dot pins to be actuated for printing, to high level "1". The rise of print pattern signal b are synchronized with the rise of the timing signal a. Delay circuit 11 receives timing signal a at high level "1" and print pattern signals (S8). Timing signal a is also sent to drive time signal generator circuit 2 (S9). The input of timing signal a to delay circuit 11 starts the counting process, starting with "0", in timer counter 11b. When the count becomes equal to the correction factor stored in correction factor registers 11a (11a-1, 11a-2, . . . , 11a-n), comparators 11c (11c-1, 11c-2, . . . , 11c-n) output high level "1". Further, taking these outputs via FFs 11d (11d-1, 11d-2, . . . , 11d-n), AND circuits 11e (11e-1, 11e-2, . . . , 11e-n), performing logical product operation with print pattern signals b, produce the delayed print pattern signals b', which are then supplied to drive circuit 3 (S10). In drive time signal generator circuit 2, when timing signal a is input charge/discharge signal d is compared with slice levels SL1 and SL2, and drive time signals T1 and T2 are transmitted to drive circuit 3 (S11). When delayed print pattern signals b' and drive time signals T1 and T2 are input to drive circuit 3 head drive signals e (#e1, #e2, . . . #en) flow into respective head coils for the respective dot pins. Dot printing is thereby performed (S12).

According to this embodiment the rising edge of print pattern signal b for each dot pin is delayed by delay circuit 11, to produce delayed print pattern signal b', by means of which the length of time for which head drive signal e for each dot pin flows is controlled. This makes it possible to apply a correction to each dot pin. Therefore, the problem of deficiency in print quality due to difference in dot print head characteristics and due to the difference in stroke between the pins at the center and edges of the print head when a round platen is used can be eliminated.

Although in the above embodiment platen correction data PL, print time correction data HD, and drive information data DR were used for calculating the correction data for each dot pin, other correction data can be used in place of or in addition to the above-mentioned correction data. Also, it may be so arranged that when the power is turned on or when there is a need to revise correction data, correction data can be revised by striking each dot pin against the platen and detecting the time of printing.

As described above, this invention allows changing the effective time of print pattern signals for respective dot pins according to correction factors that are specific to individual dot pins so that the head drive signal, i.e., the drive current for driving dot pins, can be adjusted for individual dot pins. Consequently, since dot drive time can be corrected separately for individual dot pins, rather than commonly for all dot pins, even if print time is decreased a degradation in print quality due to differences in dot print head characteristics or differences in strokes due to differences in the distance between the dot pin and the platen, can be eliminated. This allows further increases in the speed of serial dot printers. Further, since the length of time in which drive current is allowed to flow can be modified for each dot pin, the power consumption on the printer can be reduced.

In the above embodiment, the characteristics storage unit 13 comprises a memory control unit 13a and a memory 13b, which are separate from each other. In place of the combination of the memory control unit 13a and the memory 13b, a serial EEPROM having the functions of the both (memory and its control) can be used. An example of such EEPROM is ER59256 manufactured by General Instrument. Instead of using the serial interface for the memory control unit 13a, a parallel interface can be used. If the memory control unit 13a can be controlled by means of a standard interface, such as RS232C, it is possible to directly connect the interface of a personal computer and the print head so that the personal computer can read and write the characteristics values.

In the drive system described above, the time at which the drive of each dot pin is commenced is delayed. It is also possible to delay the time at which the drive of each dot pin is terminated.

Figure 13:
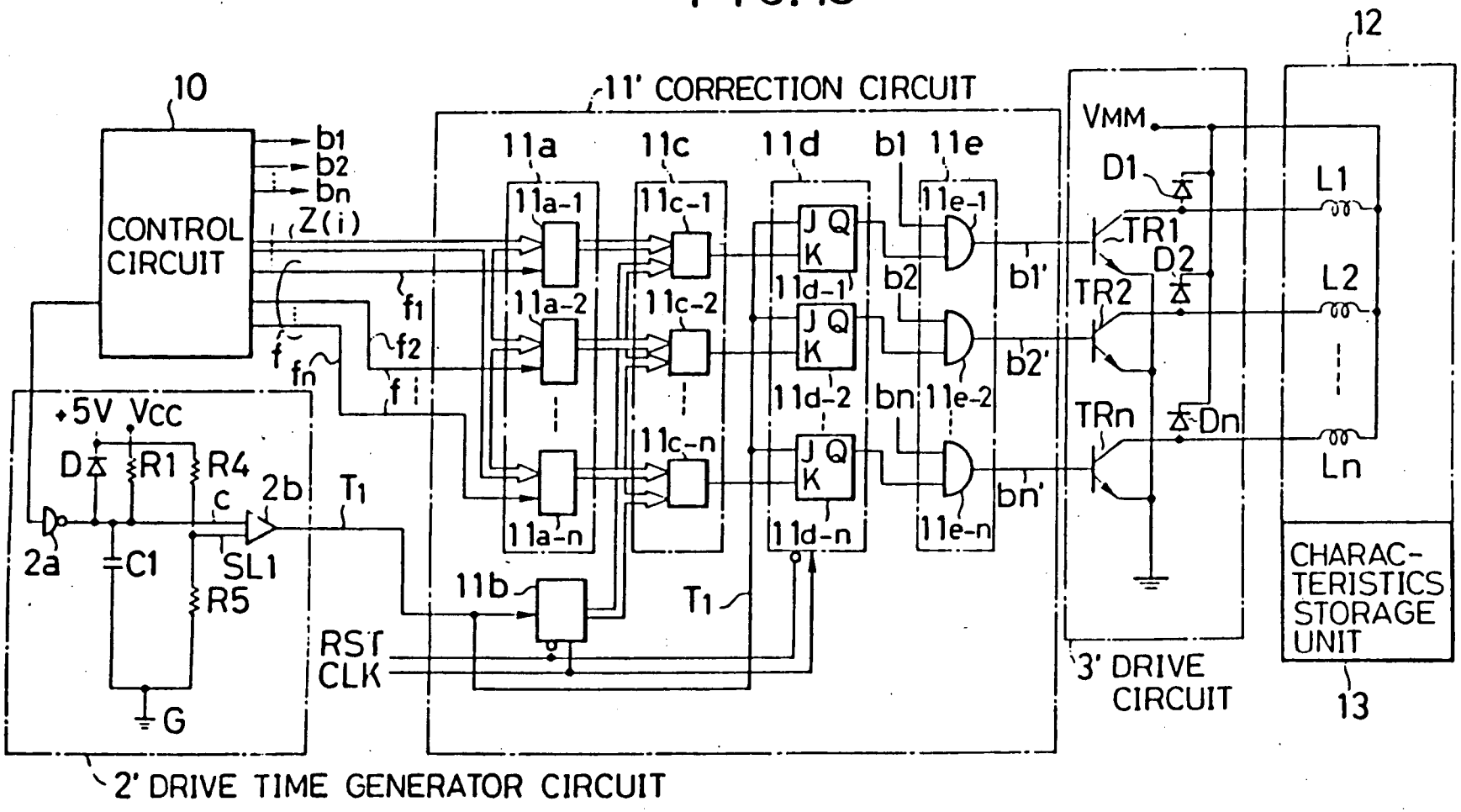
FIG. 13 is a block diagram showing another example of a control and drive unit.

FIG. 13 shows a circuit diagram showing a system in which the time at which the drive of each dot pin is terminated is delayed. The reference numerals identical to those in FIG. 5 and FIG. 7 denote identical or similar members or parts.

Figure 1:
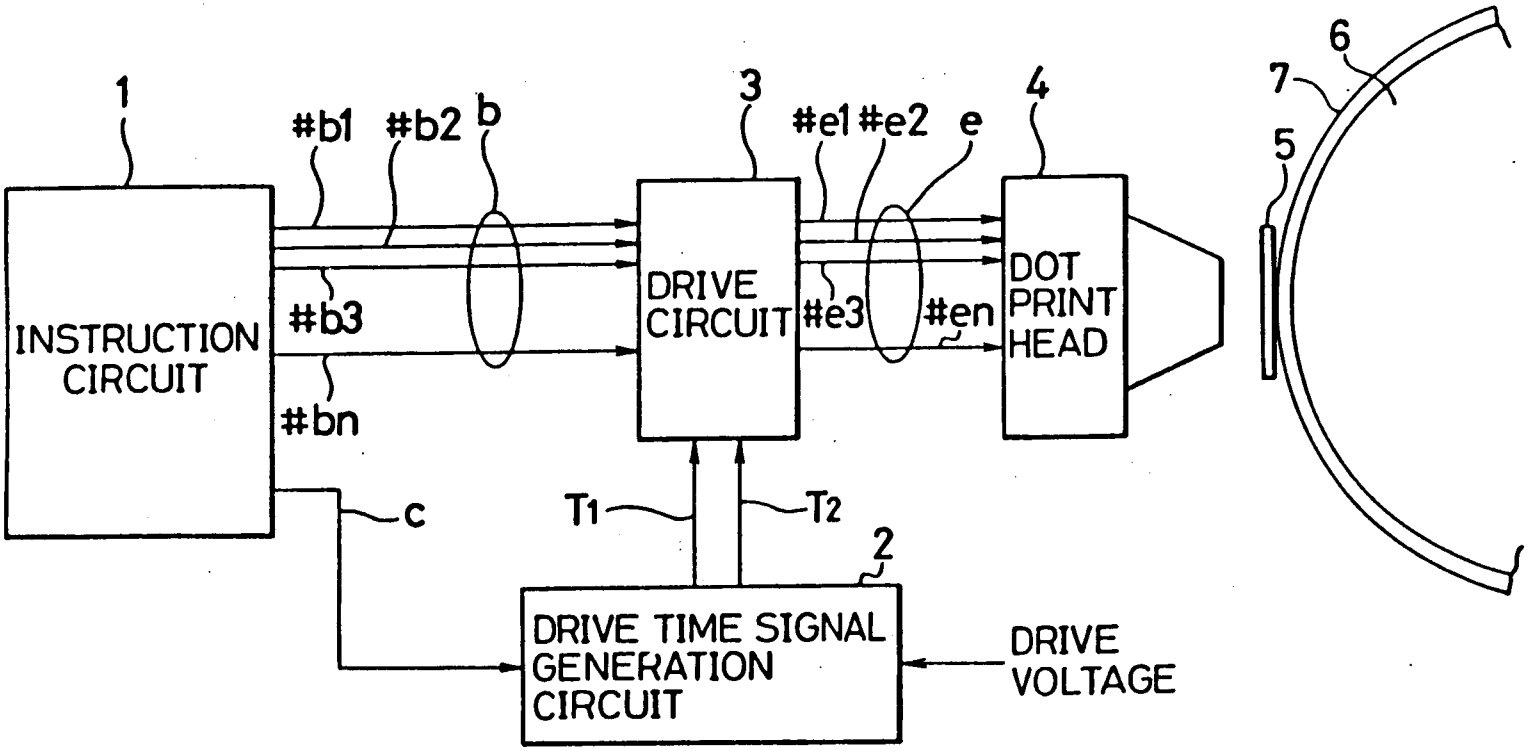
FIG. 1 PRIOR ART
FIG. 1 is a block diagram showing the dot print head control circuit to which the conventional dot print head drive method is applied.
Figure 2:
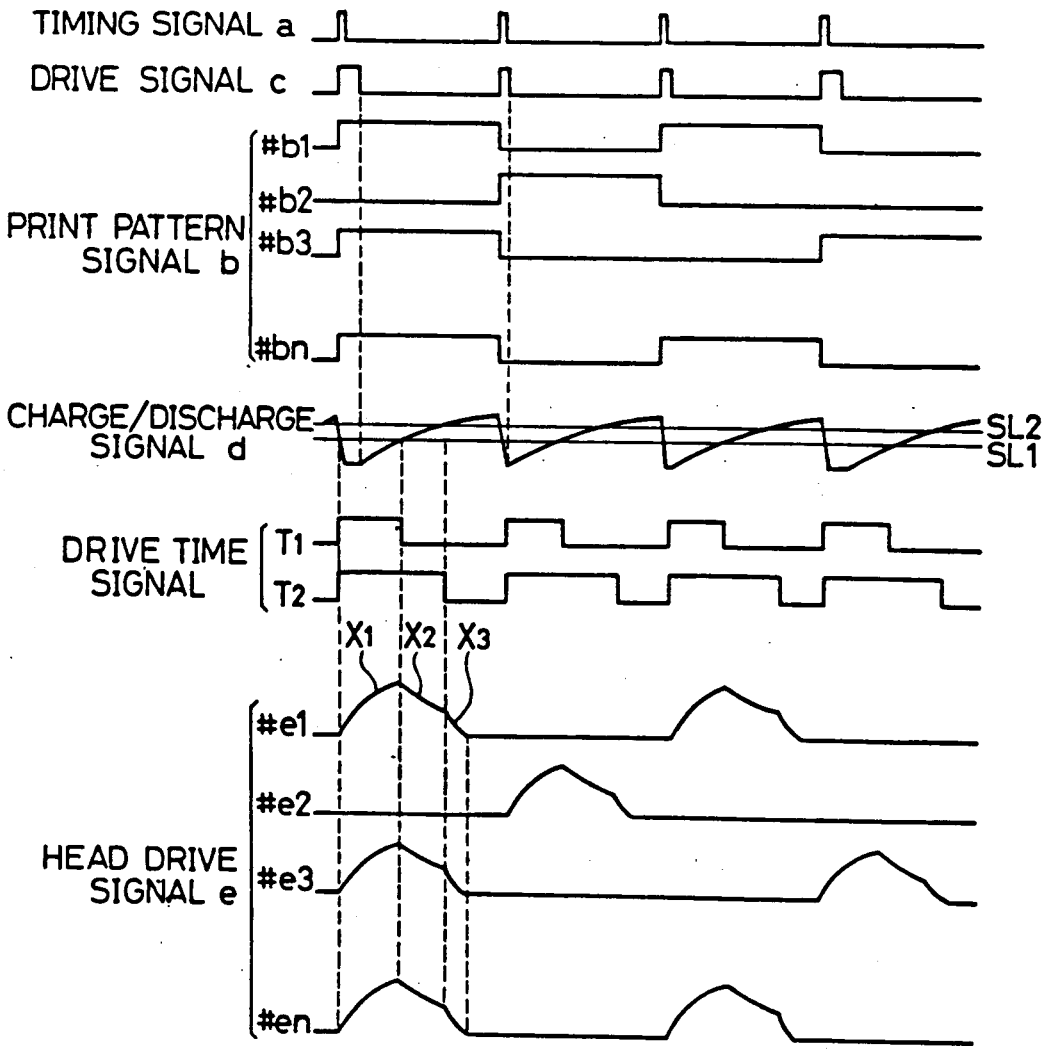
FIG.2 PRIOR ART
FIG. 2 is a timing chart illustrating the operation of components in the conventional dot print head control circuit.
Figure 3:
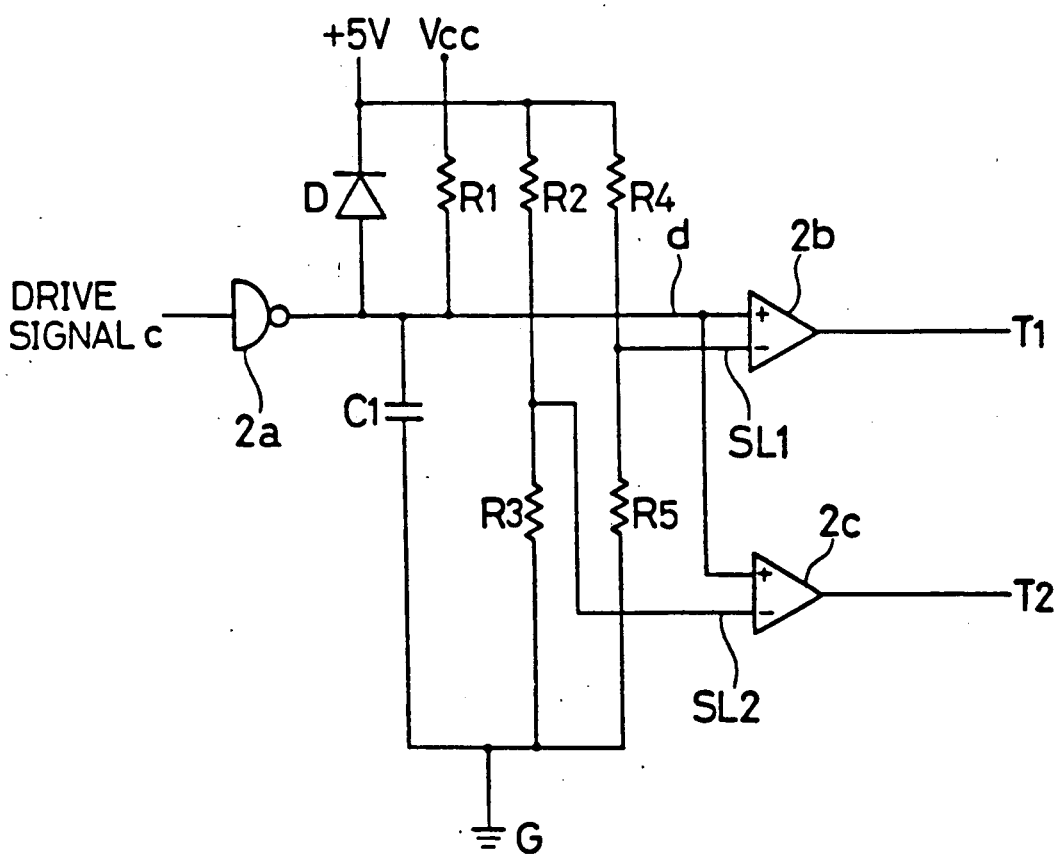
FIG. 3 PRIOR ART
FIG. 3 is a circuit diagram of a drive time signal generator circuit.

A drive time generator circuit 2' receives a timing signal a sent from the control circuit 10 and produces a drive time signal T1 upon receipt of the timing signal a alone. The circuit differs from that of FIG. 3 in that the resistors R2 and R3, and the comparator 2c are omitted.

The drive time signal T1 is sent to a correction circuit 11'.

The drive time signal T1 is supplied to a timer 11*b* and a J input of each of the FFs 11*d* of the correction circuit 11'. Each of the AND circuits 11*e*, receiving at one input terminal thereof, the corresponding one of the print pattern signals b, receives at the other input terminal thereof, the Q output of the corresponding one of the FFs 11*d*.

The drive circuit 3' receive the print pattern signals b at the bases of the transistors TR1 to TRn. That is, the AND circuits 3*a*-1 to 3*a*-n, the transistor TRn+1 and the diode Dn+1 in the circuit shown in FIG. 4 have been omitted and one ends of the colls L1 to Ln of the print head are connected directly to the drive power supply Vmm.

Figure 14:
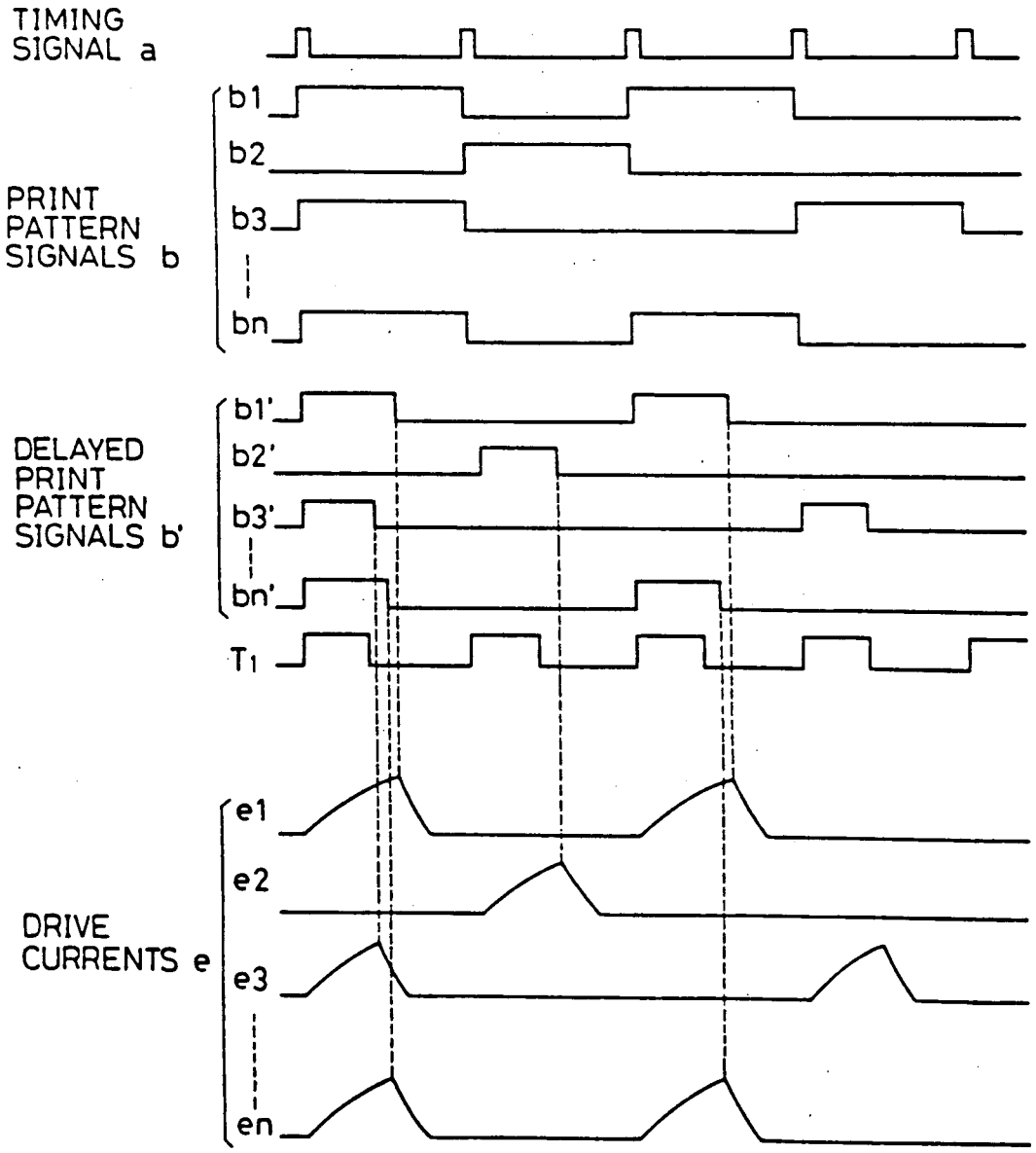
FIG. 14 is a timing chart showing the operation of the control and drive unit in FIG. 13.

The operation of the above configuration will now be described with reference to FIG. 14. It is assumed that the characteristic values Y(i) stored in the characteristics storage unit 13 are read by the control circuit 10 via the cable 14 and correction values Z(i) are calculated from the characteristic values Y(i) and sent to the correction circuit 11' and stored in the correction value registers 11*a*.

When a print command is given from a personal computer or the like, not shown, the control circuit 10 supplies the print pattern signals b to the correction circuit 11' and at the same time supplies the timing signal a to the drive time generator circuit 2'. The drive time generator circuit 2' then generate a drive signal T1 which is sent to the correction circuit 11'. The drive signal T1 input into the correction circuit 11' and applied to the timer 11*b* and the J input terminals of the FFs 11*d*. The timer 11*b* however does not operate yet. The FFs 11*d* are set in time with the clock signals CLK. The Q outputs rise to high ("1"), and are supplied to the AND circuits 11*e*. As a result, the print pattern signals b which are high pass through the AND circuits 11*e* and applied to the bases of the corresponding transistors TR1 to TRn, which are thereby turned on. The drive currents e shown in FIG. 14 thereby flow.

When the drive signal T1 goes low, the timer 11*b* begins counting. When the count value becomes equal to the correction value Z(i) stored in each of the correction value registers: 11*a* the corresponding comparator 11*c* produces a high level output which is applied to the K input terminal of the corresponding FF 11*d*. The Q output of the FF 11*d* thereby goes low and the AND circuit 11*e* is closed so that the print pattern signal b at the output of the AND circuit 11*e* goes low. The transistor (TR1 to TRn) is thereby turned off. In this way the time at which the drive of each dot pin is terminated is corrected to optimize the drive time for printing.

As an alternative, the drive time generator circuit 2' can be formed of a timer and built in the correction circuit 11'. The timer can be started by a timing signal a from the control circuit 10. This will simplify the circuit and lowers the cost.

Figures 15A, 15B:
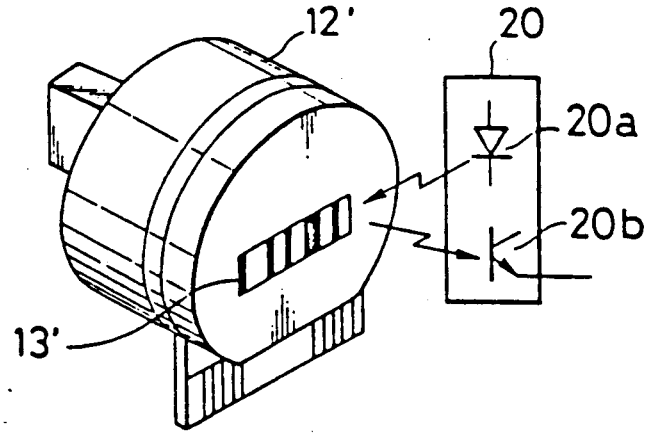
FIG. 15A and FIG. 15B show another example of a characteristics storage unit 13'.

Another example of a characteristics storage unit will now be described with reference to FIG. 15A and FIG. 15B. FIG. 15A is an oblique view of a print head 12 having a characteristics storage unit 13*a* comprising a seal with a bar code that is stuck on the surface of the print head 12 or a pattern formed, at the time of characteristics inspection, by baking (for printing) using a laser beam or the like on a surface of the print head. FIG. 15B shows how the characteristic values Y(i) can be read from the pattern. A photocoupler 20 comprising a light emitter 20*a* and a photodetector 20*b* is provided to read the characteristic values Y(i) upon power-on reset or system reset. From the characteristic values Y(i), correction values Z(i) are calculated and stored in the correction value registers 11*a* of the correction circuit 11. The rest of the operation is similar to that described in connection with the previously described embodiment.

In the embodiment described, the print head stores the characteristic values Y(i) for the individual dot pins of the particular print head. However, the characteristics storage unit of the print head may be so arranged to store a characteristic value common to all the dot pins, or in other words, a characteristic value of the entire print head. This arrangement is advantageous in that the capacity of the storage unit may be small, and/or where the variation between the dot pins is relatively small while the variation between the individual print heads is relatively large.

As has been described, according to the embodiments of the invention that have been described, the print head is provided with a characteristics storage unit 13 which stores characteristic values Y(i) inherent to the particular print head and/or the individual dot pins of the particular print head, and, upon power-on reset or system reset, the control circuit 10 reads the characteristic values Y(i) and calculates therefrom correction values Z(i) and stores the calculated correction values Z(i) in the correction value register: 11*a*. When a command for printing is given from a personal computer or other external devices the dot pins are driven for respective drive times corresponding to the respective correction values Z(i). As a result, the print quality is improved and the printing speed is increased. In addition, the values for the lower limit A and the upper limit B of the inspection standard for the delivery inspection can be relaxed.

In the embodiments described, the characteristic values Y(i) are written in a memory 13*b* of the characteristics storage unit 13 at the time of characteristics inspection after assembly of the print head. But the writing of the characteristic values can be conducted after mounting the print head on a printer. For instance, the operation panel of the printer may be arranged to permit the writing, by manipulation thereof, of a mode in which the characteristic values Y(i) can be input. The characteristic values can then be input successively and written in the memory 13*b*. After the input for all the dot pins, the printer can be returned to the ordinary mode. Alternatively, an external interface of the printer may be connected to a characteristics measurement instrument or a personal computer or the like to enable input of the characteristic values Y(i) successively. Moreover, the writing of the characteristic values can be made at the time of periodical inspection. This is advantageous where the characteristics of the print head varies with aging.

In the embodiment described, the correction of the drive time is made on the characteristic values Y(i) alone. But it may be so arranged that the correction is made on the basis of other correction factors as well. For instance, factors for compensating the differences in the distance between the dot pins and the round surface of the platen 6*a*, the distance varying from one dot pin to another due to the curvature of the platen 6*a*.

In the embodiments described, the characteristic values Y(i) are stored in the characteristics storage unit 13 and the control circuit 10 calculates the correction value Z(i). However, it is possible to calculate the correction values Z(i) and store the correction values Z(i) in the characteristics storage unit 13 in advance. In this case the control circuit 10 simply reads the correction values Z(i) and stores them in the correction value registers 11*a*.

In the embodiments described so far, the drive times are corrected for the respective dot pins in accordance with the characteristic values Y(i) or the correction values Z(i). As an alternative, a representative value, e.g., maximum value, a minimum value, an average value, variation, deviation, or the like of the characteristic values Y(i), may be used for uniform correction for all the dot pins. In this case: the variations between the dot pins cannot be corrected but the variations between the print heads can be corrected.

In the embodiments described, the characteristic values Y(i) within the characteristics storage unit 13 are read by the control circuit 10 and the drive times of the dot pins are corrected by use of the correction circuit 11. However, invention is also applicable where the print period or cycle time in which one cycle of dot pin operation is performed is altered. When the print period is lengthened, it is ensured that the dot pins which are slow in returning to the retracted position to complete the printing operation during the print period.

What is claimed is:

1. A dot matrix print head drive system for controlling head drive currents supplied to head coils respectively provided to drive dot pins via respective drive mechanisms in accordance with print pattern signals, said dot pins being driven to impact a printing medium disposed on a platen, said system comprising:

an instruction circuit means for calculating a correction factore Md(i) for each of the dot pins in accordance with the equation:

$$Md(i)=\alpha PL(i)+\beta HD(i)+\gamma DR$$

wherein

PL(i) is a factor for compensating for each difference in distance between a dot pin and a round surface of the platen due to a curvature of the platen; and HD(i) is a factor for compensating for each difference in at least one of physical and electrical characteristics of a dot pin and its drive mechanism; and DR is a factor, common to all of the dot pins, for compensating for a deviation in at least one of physical and electrical characteristics of the print head and for adjusting the density of printing, and $\alpha$, $\beta$ and $\gamma$ are preselected weighting factors;

a first memory means for storing said factors PL(i) and HD(i);

a second memory means for storing said factor DR; an input means for inputting data for rewriting said factor DR stored in said second memory means;

correction factor registers provided for respective dot pins, each of said correction factor registers storing a corresponding calculated correction factor Md(i) from said instruction circuit means for each of the dot pins;

said instruction circuit means including a means for periodically producing a timing signal;

delay circuits for respective dot pins, each delay circuit responsive to said timing signal and said correction factor for each dot pin and producing an output signal upon expiration of a delay time corresponding to said correction factor Md(i) for said each dot pin; and a control means for causing drive current to flow through respective head coils when their respective delay circuits produce said output signals, and for causing the simultaneous cessation of all of the drive currents.

2. A system according to claim 1, wherein said delay circuits comprises:

a clock signal generating means for providing clock signals;

a timer counter, which is reset by said timing signal, for counting said clock signals from said clock signal generating means;

comparators provided for respective dot pins, each of said comparators comparing said correction factor Md(i) from a corresponding correction factor register with a count from said timer counter, and producing an output signal when said count becomes equal to said correction factor;

said output signal of each said comparator constituting said output signal of said delay circuit.

3. A system according to claim 1, wherein said instruction circuit means includes means for periodically producing said print pattern signals provided for the respective dot pins, each of the print pattern signals are arranged to be at a High level during a particular print cycle if a corresponding dot pin is to be driven during that particular print cycle, and wherein all of the print pattern signals which becomes a High level during a print cycle are arranged to be at a High level item at a Low level simultaneously; and said control means causes the cessation of the drive currents when the correponding print pattern signals become a Low level.

4. A system according to claim 1, wherein said control means comprises:

flip-flops provided for respective dot pins, each of said flip-flops being placed in a first state by said timing signal, and placed in a second state by said signal from its corresponding delay circuit, each of said flip-flops producing a signal in its second state;

AND gates provided for respective dot pins, each of said AND gates receiving a corresponding print pattern signal and said signal from its corresponding flip-flop and for producing a High level output signal in response to simultaneous High levels of said print pattern signal and said signal from its corresponding flip-flop; and a means for causing each of the drive currents to flow through a corresponding head coil when said output signal of its corresponding AND gate is at a High level.

5. A system according to claim 1, wherein said first memory means is a ROM and said second memory means is a RAM.

6. A printer comprising:

a dot print head comprising a plurality of dot pins and also comprising a data memory means for storing characteristic values for individual respective dot pins or correction values corresponding to said characteristic values;

a control and drive unit for reading said characteristic values or said correction values at a time of occurrence of a power-on or system reset of the printer and for driving each of respective dot pins of said print head for a drive time or drive period whose value is determined in accordance with said characteristic values or said correction values;

wherein said print head is selectively disconnectable from said control and drive unit.

7. A printer according to claim 8, further comprising a printer main unit; wherein said dot print head is detachably fixed to said printer main unit.

8. A printer according to claim 6, wherein said control and drive unit stores said correction values, and drives respective dot pins for a varying length of time in accordance with said stored correction values.

9. A printer according to claim 6, wherein said data memory means of said print head comprises a built-in printed circuit board, a non-volatile memory mounted on said printed circuit board for storing said characteristic values or said correction values, and a memory control means for controlling reading and writing of said characteristic values or said correction values from said memory and into said memory.

10. A printer according to claim 6, wherein said characteristic values of said print head are those values obtained by measurement for that particular print head.

* * * * *